US005826381A

United States Patent [19]

Sasaki

[11] Patent Number: 5,826,381

[45] Date of Patent: Oct. 27, 1998

[54] THREE-DIMENSIONAL PLACE-ON TYPE ASSEMBLABLE STRUCTURE

[76] Inventor: Mitsuo Sasaki, 3-11-12 Yamato-higashi, Yamato-shi, Kanagawa-ken, Japan

[21] Appl. No.: 670,979

[22] Filed: Jun. 28, 1996

[30] Foreign Application Priority Data

Jul. 10, 1995 [JP] Japan ..... 7-195787

[51] Int. Cl.[6] ..... E04H 6/42

[52] U.S. Cl. ..... 52/175; 52/236.3; 52/263; 52/299

[58] Field of Search ..... 52/175, 234, 236.3, 52/263, 299, 480

[56] References Cited

U.S. PATENT DOCUMENTS

| | | | |
|---|---|---|---|
| 3,813,835 | 6/1974 | Rice | 52/236.3 X |
| 4,173,103 | 11/1979 | Sargis | 52/234 X |
| 4,575,978 | 3/1986 | Huhn et al. | 52/234 |
| 4,800,694 | 1/1989 | Sasaki | 52/175 |
| 4,989,382 | 2/1991 | Spronken | 52/236.9 X |
| 5,177,913 | 1/1993 | Erel | 52/175 X |
| 5,185,978 | 2/1993 | Sasaki | 52/175 |
| 5,305,563 | 4/1994 | Erel | 52/175 X |

FOREIGN PATENT DOCUMENTS

| | | | |
|---|---|---|---|
| 1791556 | 1/1993 | U.S.S.R. | 52/236.3 |

*Primary Examiner*—Carl D. Friedman
*Assistant Examiner*—Timothy B. Kang
*Attorney, Agent, or Firm*—Beveridge, DeGrandi, Weilacher & Young, LLP

[57] ABSTRACT

A three-dimensional structure adapted to be assembled dissociably and placed on a substantially flat surface is disclosed. This structure includes a plurality of upright support members each integrally molded from concrete, the upright support members each including a base portion extending horizontally with a predetermined width, and being to be placed on the surface; and an upright portion extending upwardly from the base portion, and having opposite side surfaces defining a widthwise thickness and opposite end surfaces defining a horizontal length. These upright support members are spaced from each other in a horizontally transverse direction and a horizontally longitudinal direction. Transversely adjacent upright support members are connected together by beam means, while longitudinally adjacent upright support members are connected together by connecting means.

3 Claims, 16 Drawing Sheets

THREE-DIMENSIONAL PLACE-ON TYPE ASSEMBLABLE STRUCTURE

FIELD OF THE INVENTION

This invention relates to a three-dimensional place-on type assemblable structure which is assembled dissociably and placed on a substantially flat surface such as the ground surface. The structure of the invention is used, for example, for three-dimensional parking places for automobiles or bicycles, and constructions including sport parks and multipurpose parks.

DESCRIPTION OF PRIOR ART

Three-dimensional structures, such as car parks, have two or more stories of parking spaces for ensuring a parking capacity in the urban area. Like ordinary buildings, these are built on a foundation constructed in the ground. These multistory car parks permanently set up on the land pose the following problems: (1) A long period of time and a high cost are required for construction, as in the case of ordinary buildings. (2) If the land is to be used for other purpose, the foundation and the multistory car park must be scrapped, and the building materials cannot be reused effectively.

To solve these problems, I, the inventor, proposed a three-dimensional place-on type assemblable vehicle parking structure, comprising corner assembly elements, side assembly elements, and center assembly elements disposed at required positions; beam members connecting the upper ends of the pillars of adjoining assembly elements; and brace members connecting the lower ends of the pillars of adjoining assembly elements (Japanese Patent Publication No. 6-15786 and U.S. Pat. No. 4,800,694). This three-dimensional vehicle parking structure can be assembled dissociably in a short time and at a low cost, is strong and rigid enough to serve as a three-dimensional parking lot without requiring an embedded foundation, and is thus capable of clearing the aforementioned problems.

Needless to say, a structure is more convenient to use and more advantageous as a usable space if the area of its installation is larger. The fewer the kinds of its constituent members and the simpler their makeups are, the easier its production is, and the shorter its assembly time is. Therefore, its construction cost becomes lower.

In constructing the aforementioned conventional three-dimensional structure, corner pillars (corner assembly elements), side pillars (side assembly elements) and central pillars (central assembly elements) are prepared and used at predetermined positions of the corners, sides and center of the structure. The three-dimensional structure requires relatively many pillars in the area of installation. Of its inner spaces, therefore, the spaces in the vicinity of the center are narrowed by many pillars, such as the respective central pillars and the side pillars defining the widths of the entrance and the exit. As a result, the spaces available are not large enough, posing the problem of inconvenience. Moreover, three kinds of pillars are required as the constituent members, leaving unresolved the simplification (standardization) of the constituent members.

SUMMARY OF THE INVENTION

An object of the present invention is to provide an improved three-dimensional place-on type assemblable structure which can give a much larger usable space than that of a conventional pillar-structured three-dimensional structure in the same area of installation.

Another object of the present invention is to provide an improved three-dimensional place-on type assemblable structure whose area increase in horizontally transverse and longitudinal directions is easy, and whose vertically upward expansion is also easy.

Still another object of the present invention is to provide an improved three-dimensional place-on type assemblable structure whose entire assembly time is markedly shortened and whose construction cost is further decreased, since its constituent members have been considerably simplified and are thus produced even more efficiently.

According to the present invention, there is provided a three-dimensional structure adapted to be assembled dissociably and placed on a substantially flat surface, the structure including a plurality of upright support members each integrally molded from concrete, the upright support members each comprising a base portion extending horizontally for a predetermined length with a predetermined width, and being to be placed on the surface; and an upright portion extending substantially vertically upwardly from the base portion, and having opposite side surfaces defining a widthwise thickness and opposite end surfaces defining a horizontal length, wherein the upright support members are spaced from each other in a horizontally transverse direction and in a horizontally longitudinal direction perpendicular to the horizontally transverse direction, the upright support members adjacent to each other in the horizontally transverse direction are disposed with a predetermined spacing in the horizontally transverse direction, with one end surface of the upright portion of one of the adjacent upright support members being caused to face one end surface of the upright portion of the other upright support member, and are separably connected together by beam means, and the upright support members adjacent to each other in the horizontally longitudinal direction are disposed with a predetermined spacing in the horizontally longitudinal direction, with one side surface of the upright portion of one of the adjacent upright support members being caused to face one side surface of the upright portion of the other upright support member, and are separably connected together by connecting means.

In the three-dimensional structure of the present invention, each of the upright support members is integrally molded from concrete, and is wall-structured compared with the conventional structure that is pillar-structured. The respective upright support members are disposed with one end surface of the upright portion of each of them being caused to face one end surface of the upright portion of another adjacent one of them in the horizontally transverse direction, and are separably connected together by beam means. They are also disposed with one side surface of the upright portion of each of them being caused to face one side surface of the upright portion of another adjacent one of them in the horizontally longitudinal direction, and are separably connected together by connecting means. Assuming that the three-dimensional structure of the present invention having this constitution and the aforementioned conventional three-dimensional structure occupy the same area of installation, let the upright support members in the present invention be used at the corners and on the sides. In this case, all of the side pillars adjacent in the horizontally transverse direction to the corner pillars (the side pillars on the entrance and exit sides) and the central pillars, as used in the conventional structure, can be eliminated. Furthermore, the horizontally transverse length of each of the upright support members can be made shorter than the horizontally transverse length from each of the corner pillars to the corresponding side pillar, and than the horizontally transverse length from each of the other side pillars to the corresponding central pillar. This is due to the fact that each of the upright support members assumes a concrete wall structure.

According to the three-dimensional structure of the present invention, therefore, many pillars as used in the conventional structure are not necessary. Particularly, the pillars located in spaces in the vicinity of the center among the inner spaces can be eliminated. Thus, a much larger usable space than in the conventional structure can be secured in the same area of installation, thereby increasing convenience further. When this three-dimensional structure is utilized as a parking lot, a driving operation for entering and leaving there becomes easier than in the conventional structure. If it is used as a warehouse where an operating vehicle such as a fork lift truck works, its travel and operation become easier, improving the operating efficiency.

With the three-dimensional structure of the present invention, extension of the area in the horizontally transverse and longitudinal directions can be easily accomplished by increasing the number of the upright support members arranged in the horizontally transverse direction and the number of the upright support members arranged in the horizontally longitudinal direction. On the other hand, the upward expansion of the area, namely, the increase of the height to the third floor, the fourth floor and so forth, can be achieved by increasing the height of each upright support member according to the number of the stories to be desired. These modifications are easy, because each of the upright support members has been integrally molded from concrete. For those modifications, the beam means and the connecting means are increased suitably depending on the number of the stories to be constructed.

In the three-dimensional structure of the present invention, moreover, one type of upright support member as described is used instead of the plural kinds of pillars used in the conventional structure. In addition, each of the upright support members is integrally molded from concrete. Compared with the conventional pillar structure produced by welding many steel plates, therefore, the constituent members are markedly simplified, and their production is performed more efficiently than in the conventional structure. Besides, the adjacent upright support members are connected separably by beam means and connecting means. Thus, the assembly time and the disassembly time are very short, and the constituent members after disassembly can be reused.

Since each upright support member is integrally molded from concrete (e.g., precast concrete), furthermore, a form can be brought to the site of construction, and each of the upright support members produced there. Consequently, the costs to be borne, such as transportation cost, can be decreased, reducing the costs of construction. The three-dimensional structure of the present invention also has many advantages of a place-on type structure, such as no need for foundation work.

The present invention further provides a three-dimensional structure having, in addition to the aforementioned constitution, a constitution in which each of the upright support members is substantially the same in makeup.

According to this another aspect of the invention, each of the upright support members is integrally molded from concrete, and is composed of common parts. Thus, the production of each upright support member is efficiently performed, markedly shortening the assembly time for the whole three-dimensional structure, and accordingly, the period of construction work. This makes the cost of construction even lower.

According to the present invention, there is provided, in addition to the constitution described as the first aspect, a three-dimensional structure, wherein the beam means are each disposed so as to connect together upper end parts of the one end surface of the upright portion of each of the upright support members and the one end surface of the upright portion of another of the upright support members, the former one end surface and the latter one end surface being caused to face each other in the horizontally transverse direction, one end surface of each of the upright support members is defined by the one end surface of the upright portion and one end surface of the base portion, while the other end surface of each of the upright support members is defined by the other end surface of the upright portion and the other end surface of the base portion, and a recess concaving toward the other end surface of each of the upright support members from the one end surface in the upper end part of the upright portion and from the one end surface of the base portion is formed at that lower portion in the one end surface of each of the upright support members and the one end surface of the upright portion which excludes at least the upper end part.

In this invention, one end surface of each of the upright support members facing the central portion in the inner space is concave in a direction in which the central portion widens. Thus, the usable space is expanded in an amount corresponding to the concavities, improving convenience further. Specifically, when this three-dimensional structure is used as a parking lot, interference by the opening and closing of that door of an automobile parked which faces the upright support member is prevented, making it easy for the car user to get on and off.

According to the present invention, there is further provided a three-dimensional structure adapted to be assembled dissociably and placed on a substantially flat surface, the structure including a plurality of upright support members each integrally molded from concrete, the upright support members each comprising a base portion extending horizontally for a predetermined length with a predetermined width, and being to be placed on the surface; and an upright portion extending substantially vertically upwardly from the base portion, and having opposite side surfaces defining a widthwise thickness and opposite end surfaces defining a horizontal length, wherein the upright support members are spaced from each other in a horizontally transverse direction and in a horizontally longitudinal direction perpendicular to the horizontally transverse direction, the upright support members adjacent to each other in the horizontally transverse direction are disposed with a predetermined spacing in the horizontally transverse direction, with one end surface of the upright portion of one of the adjacent upright support members being caused to face one end surface of the upright portion of the other upright support member, and are separably connected together by beam means, the upright support members adjacent to each other in the horizontally longitudinal direction are disposed with a predetermined spacing in the horizontally longitudinal direction, with one side surface of the upright portion of one of the adjacent upright support members being caused to face one side surface of the upright portion of the other upright support member, and are separably connected together by connecting means, and the plurality of upright support members comprise a pair of corner upright support members disposed at each of the opposite ends in the horizontally longitudinal direction, and plural pairs of side upright support members spaced from each other in the horizontally longitudinal direction between the respective pairs of corner upright support members.

The above-described aspect of the invention also achieves substantially the same actions and effects as those of the first aspect of the invention. According to its constitution, as compared with the conventional constitution, all of the side pillars adjacent in the horizontally transverse direction to the corner pillars (the side pillars on the entrance and exit sides) and the central pillars can be eliminated. Thus, of the inner spaces, spaces in the vicinity of the central portion, in particular, are expanded further. These effects will be understood more easily.

Other characteristics of the three-dimensional structure of the present invention will become apparent from the following description and appended drawings.

DETAILED DESCRIPTION OF THE PREFERRED EMBODIMENTS

Embodiments of a three-dimensional place-on type assemblable structure constructed in accordance with the present invention will be described in detail by reference to the accompanying drawings.

Figure 1:
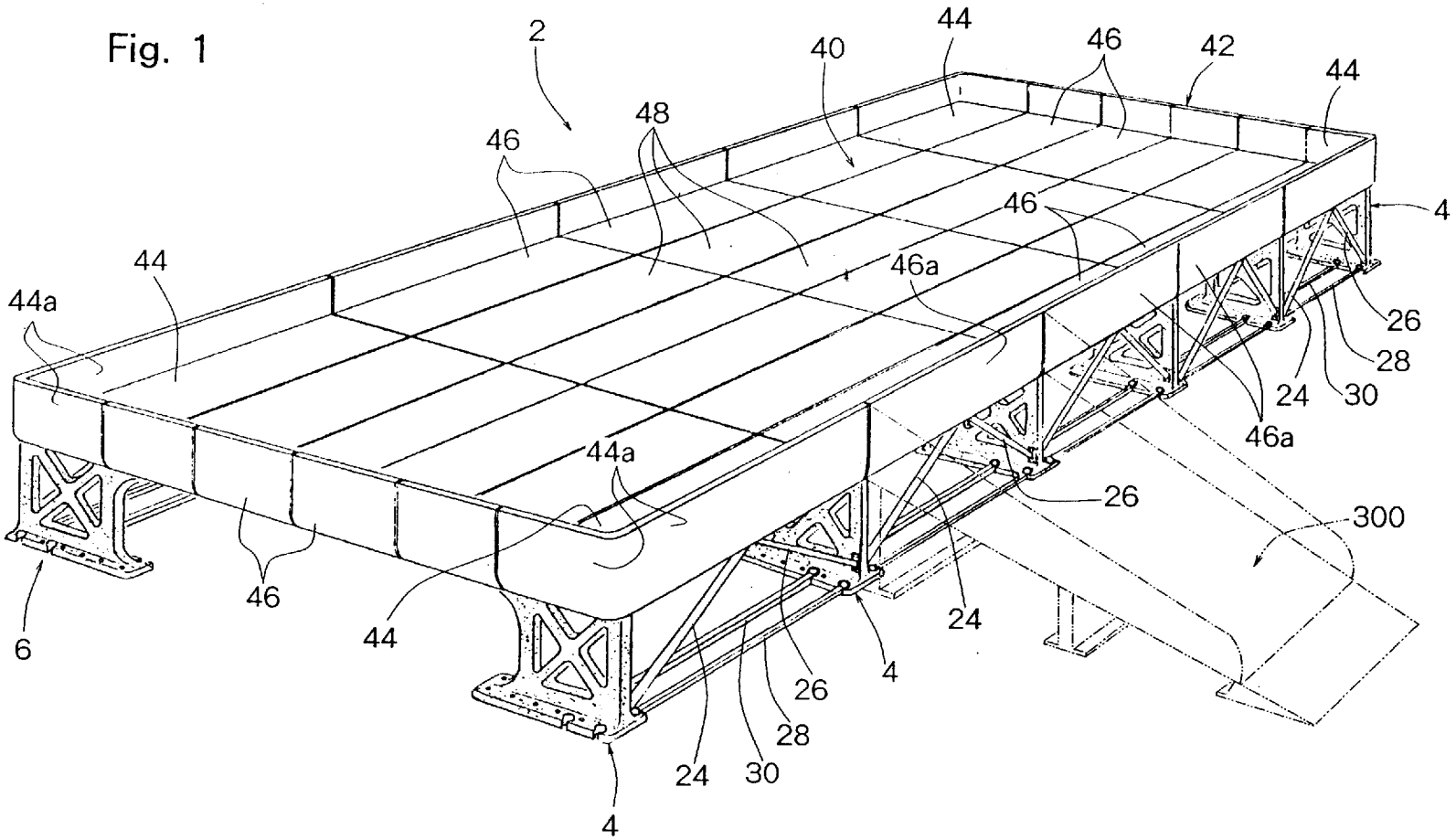
FIG. 1 is a perspective view showing an embodiment of a three-dimensional place-on type assemblable structure concerned with the present invention.
Figure 2:
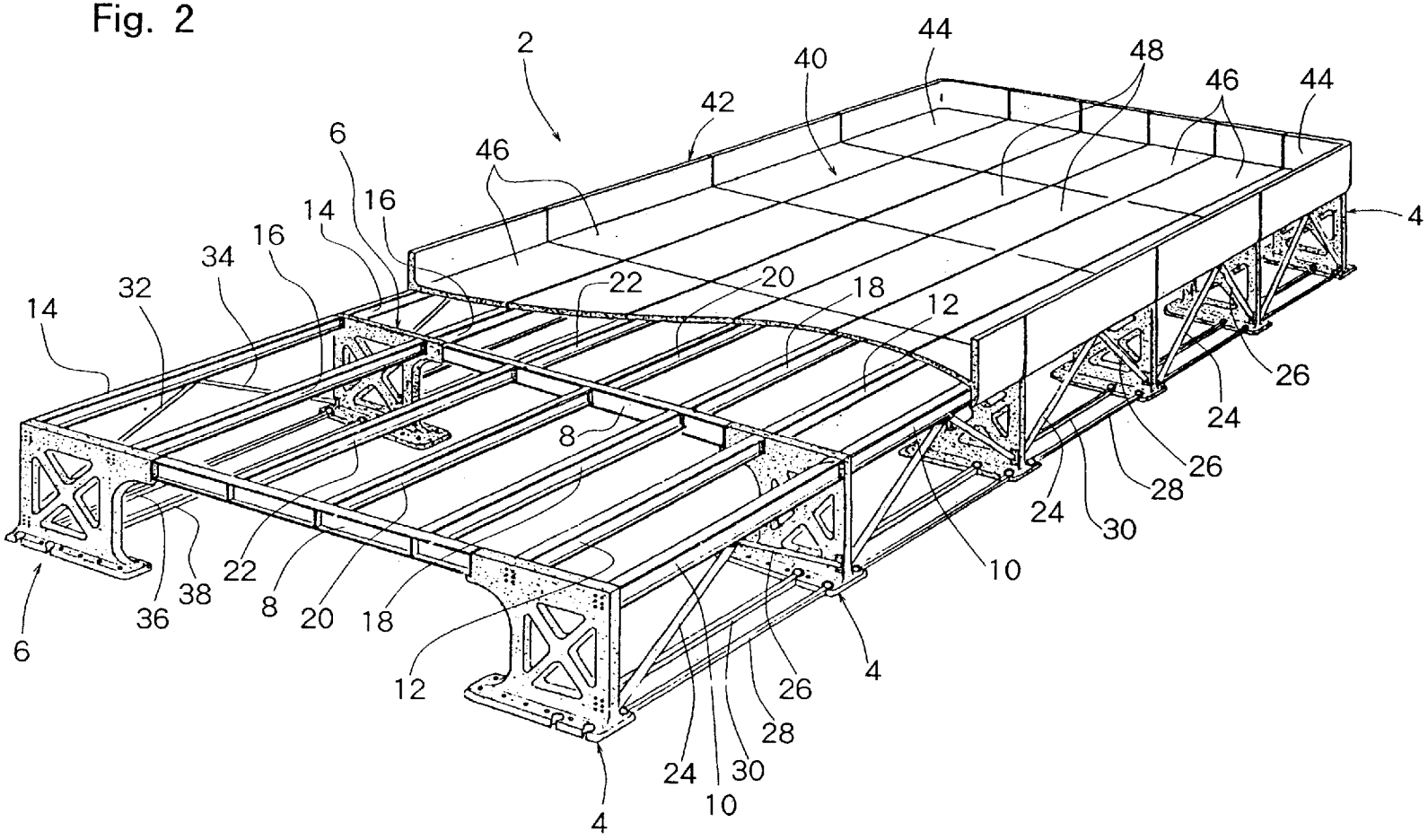
FIG. 2 is a view, partly broken away, of the structure shown in FIG. 1.
Figure 3:
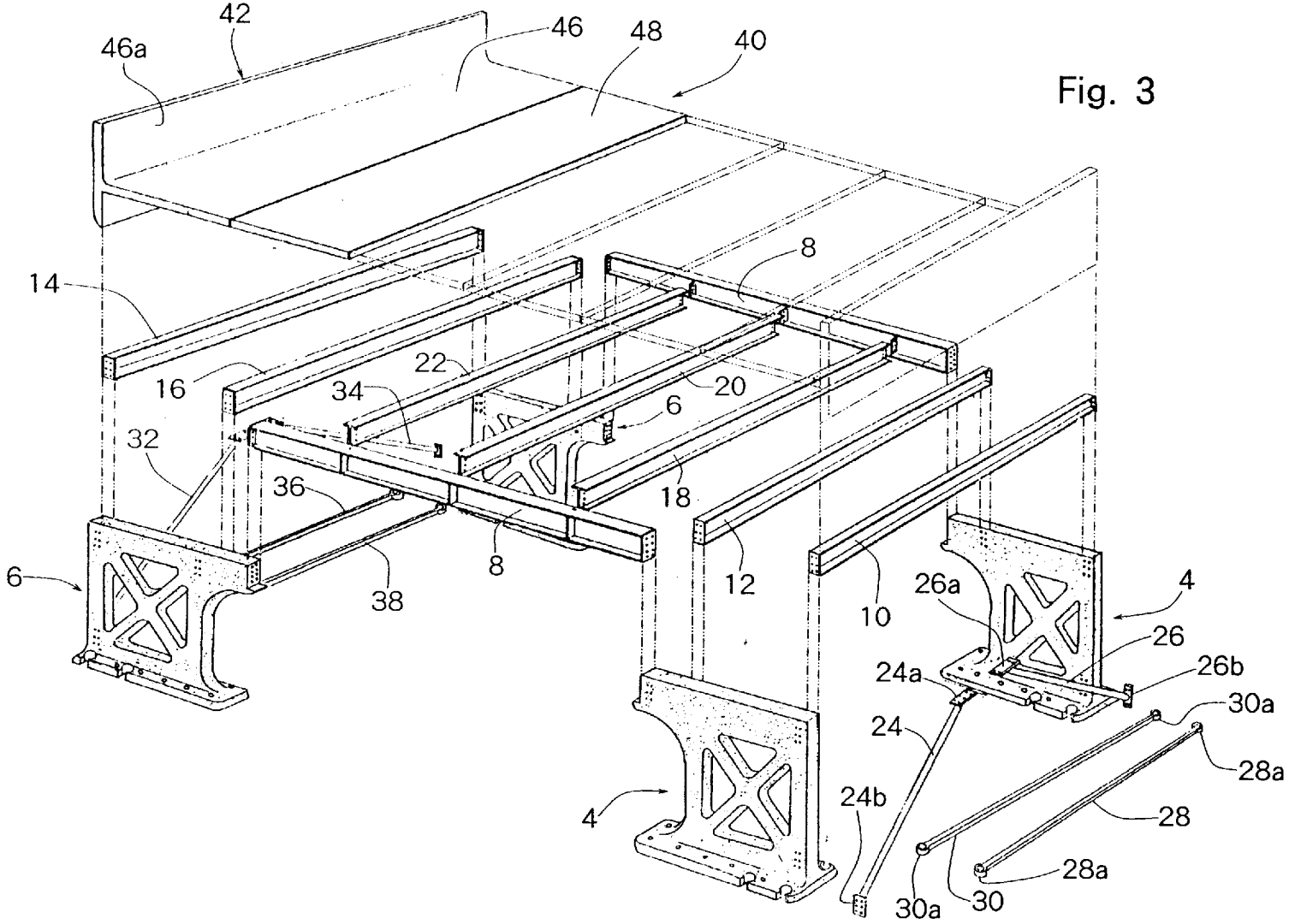
FIG. 3 is a view, partly exploded, of the structure shown in FIG. 2.

First, the entire constitution of a three-dimensional place-on type assemblable structure 2 will be outlined with reference to FIG. 1 to FIG. 3. The three-dimensional structure 2 for use as a 2-storied parking lot is assembled dissociably in a rectangular form as a whole, and is placed on a substantially flat surface which may be the ground surface. The numerals 4 and 6 signify upright support members each molded integrally from concrete, and have substantially the same makeup. The upright support members 4 and 6 are disposed with spacing in a horizontally transverse direction, and also disposed with spacing in a horizontally longitudinal direction perpendicular to the horizontally transverse direction. Herein, the wording "horizontally transverse direction" means a width direction of the three-dimensional structure 2 (a nearly upper left-to-lower right direction in FIG. 1 and FIG. 2), while the wording "horizontally longitudinal direction" means a longitudinal direction of the three-dimensional structure 2 (a nearly lower left-to-upper right direction in FIG. 1 and FIG. 2). Hereinafter, "in the horizontally transverse direction" will be referred to as "in the transverse direction" or "transversely", and "in the horizontally longitudinal direction" as "in the longitudinal direction" or "longitudinally".

The transverse spacing between the upright support members 4 and 6 is substantially the same as the transverse spacing between another combination of the upright support members 4 and 6. The longitudinal spacing between adjacent upright support members 4 is substantially the same. The longitudinal spacing between adjacent upright support members 6 is also substantially the same. Upper end parts, face-to-face in the transverse direction, of the upright support members 4 and 6 are separably connected together by one transverse beam member 8. Upper end parts, face-to-face in the longitudinal direction, of adjacent upright support members 4 are separably connected together by two longitudinal beam members 10 and 12. Upper end parts, face-to-face in the longitudinal direction, of adjacent upright support members 6 are separably connected together by two longitudinal beam members 14 and 16. Adjacent transverse beam members 8 are separably connected together by three longitudinal beam members 18, 20 and 22. These beam members 8 to 22 are each formed of an H-shaped steel.

The lower ends of adjacent upright support members 4, and the center of the lower end of the longitudinal beam member 10 that connect them together are separably connected together by brace members 24 and 26. The lower ends of adjacent upright support members 4 are also separably connected together by two brace members 28 and 30. On the other hand, the lower ends of adjacent upright support members 6, and the center of the lower end of he longitudinal beam member 14 that connect them together are separably connected together by brace members 32 and 34. The lower ends of adjacent upright support members 6 are also separably connected together by two brace members 36 and 38. The brace members 30 and 38 disposed inwards can function as stoppers for the wheels of an automobile parked. Each of the transverse beam members 8 constitutes a beam means for connecting the upright support members 4 and 6 together, while each of the longitudinal beam members 10 to 16 and each of the brace members 24 to 38 constitute connecting means for connecting together adjacent upright support members 4 or 6.

The upper surfaces of each of the upright support members 4 and 6, each of the transverse beam members 8, and each of the longitudinal beam members 10 to 22 are positioned on substantially the same horizontal place, and the floor 40 of the second story is detachably mounted on these upper surfaces. At a substantially rectangular peripheral edge portion of the floor 40 is provided an upright fence 42. The floor 40 is composed of a plurality of corner floor panel members 44, side floor panel members 46 and central floor panel members 48. The floor panel members 44 to 48 are each substantially rectangular, and each molded integrally from concrete. At two side portions of each corner floor panel member 44 is provided an upright fence 44*a* integrally. At one side portion of each side floor panel member 46 is integrally provided an upright fence 46*a*. Although not shown, part of the central floor panel member 48 and the side floor panel member 46 may be formed of a checker plate panel or an expanded metal panel which may be well known per se.

The three-dimensional structure 2 illustrated in FIG. 1 is provided with an inclined passage structure 300 connecting the floor 40 to the ground surface (see two-dot chain lines in FIG. 1). The inclined passage structure 300 is used for an automobile to ascend to and descend from the second story defined by the floor 40. The fence 46*a* for the side floor panel member 46 where the inclined passage structure 300 is to be disposed is removed.

Figure 4:
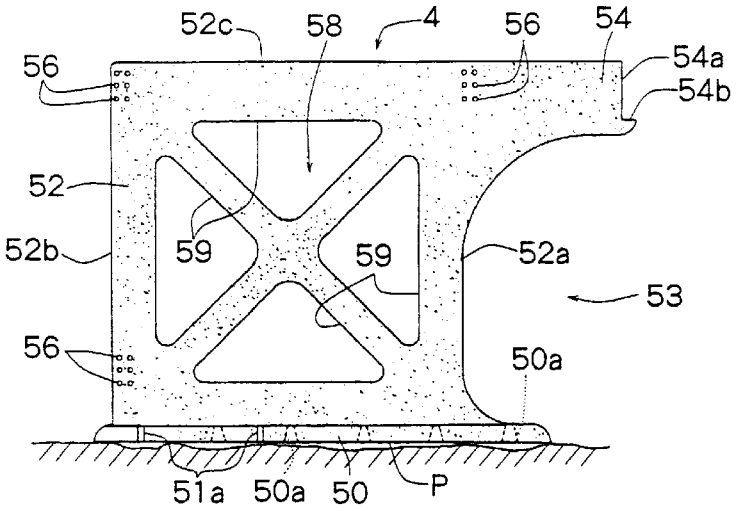
FIG. 4 is a front view of an upright support member for use in the structure shown in FIG. 1.
Figure 5:
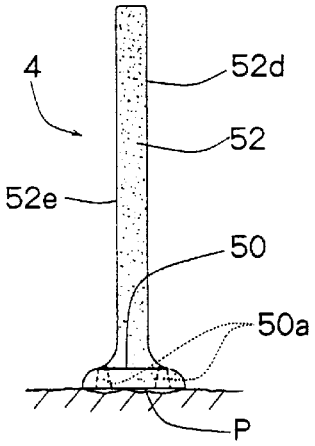
FIG. 5 is a left side view of FIG. 4.
Figure 6:
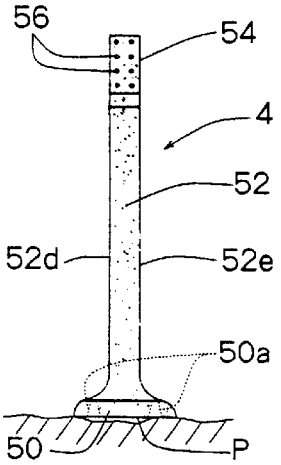
FIG. 6 is a right side view of FIG. 4.
Figure 7:
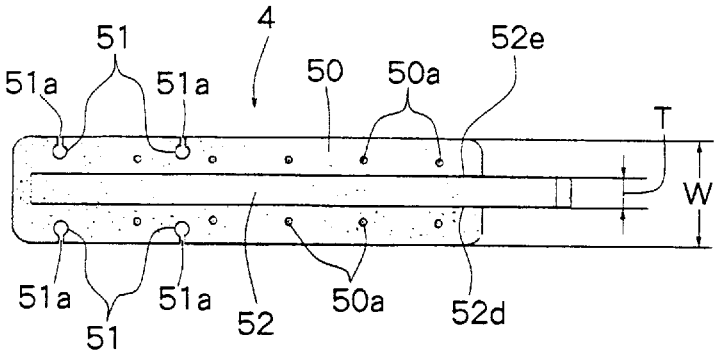
FIG. 7 is a plan view of FIG. 4.

Next, the upright support member will be described with reference to FIG. 4 to FIG. 7. The upright support members 4 and 6 have substantially the same makeup, and thus only the upright support member 4 will be explained. The upright support member 4 integrally molded from concrete (in this embodiment, precast concrete) includes a base portion 50 extending horizontally for a predetermined length with a predetermined width and having a bottom surface P to be placed on a surface, optionally, the ground surface; and an upright portion 52 extending substantially vertically upwardly from the base portion 50. As shown in FIG. 4, the upright portion 52 is nearly rectangular when viewed from the front, and has nearly the same thickness as a whole. The bottom surface P of the base portion 50 is formed of a flat horizontal surface. The base portion 50 is also in a slender rectangular form when viewed from the top as shown in FIG. 7.

At an upper end part of one end surface 52*a* of the upright portion 52 is integrally molded a cantilever beam portion 54 extending outwardly from the one end surface. An up-and-down direction middle part of the one end surface 52*a* is upright, and curved parts connect the upright middle part to the cantilever beam portion 54, as well as the middle part to the base portion 50 (see FIG. 4). As is clear from FIG. 4, the up-and-down direction middle part of the one end surface 52*a* forms a recess 53 concaving toward the other end surface 52*b*. By reference to FIG. 8 as well, a front end part of the cantilever beam portion 54 forms a connecting part for connection to the transverse beam member 8. At an upper part of the front end part is formed a vertical surface 54*a*. At the lower end of the vertical surface 54*a* is formed a horizontal surface 54*b* extending outwardly. In the upper part of the front end part are embedded eight hollow screws 56 which are known per se. The other end surface 52*b* of the upright portion 52 makes a vertical surface, while its upper surface 52*c* makes a horizontal surface. Side surfaces 52*d* and 52*e* defining the thickness of the upright portion 52 are comprised of substantially flat vertical surfaces which are parallel to each other.

At a central part of the upright portion 52 is formed an X-shaped diagonal bracing portion 58. The diagonal bracing portion 58 is defined by four triangular through-holes 59 formed so as to pass from the side surface 52*d* to the 52*e*. In molding the upright support member 4 from concrete, reinforcements are disposed at important positions inside it, as known among people skilled in the art, although they are not shown. At important positions of the diagonal bracing portion 58 as well, reinforcements are disposed. There may be embodiments in which instead of the X-shaped diagonal bracing portion 58, an inverted V-shaped diagonal bracing portion defined by three through-holes is formed, or square or circular through-holes are provided, although they are not shown.

Figure 9:
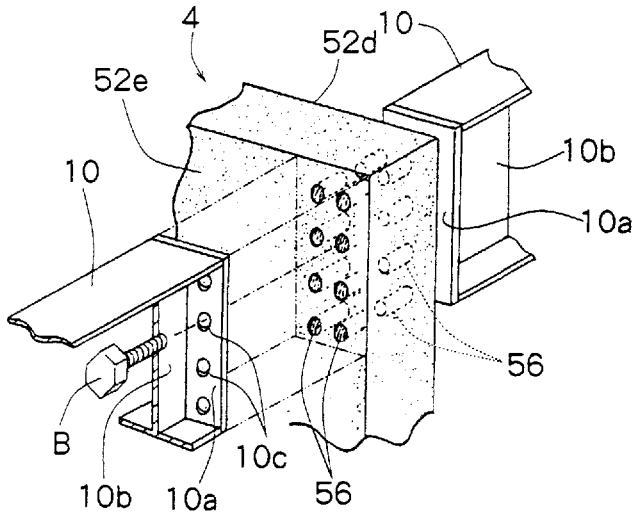
FIG. 9 is an exploded perspective view showing the joint between the upright support member and the longitudinal beam member.

By reference to FIG. 9 as well, connecting parts for connection to the longitudinal beam members 10 and 12 are formed at two sites of upper end parts of the side surfaces 52*d* and 52*e* of the upright portion 52. At each of these connecting parts are embedded six hollow screws 56 having the same makeup as stated earlier. At one site of each of lower end parts of the side surfaces 52*d* and 52*e* of the upright portion 52 is formed a connecting part for connection to the brace member 24 or 26. At the connecting part are embedded six hollow screws 56 having the same makeup as stated above.

The base portion 50 has a width W wider than the thickness T of the upright portion 52 (see FIG. 7). At opposite side parts of the base portion 50 are formed a plurality of through-holes 50*a* spaced from each other so as to pass from the upper surface to the bottom surface P of the base portion 50. The diameter of the through-hole 50*a* increases as its depth increases. If the surface where the base portion 50 of the upright support member 4, such as that of concrete or asphalt, is not even, or is inclined, it is possible to perform grouting using a binding material, such as cement mortar, or a chemical such as water glass, through the through-holes 50*a*. By this measure, the gaps between the bottom surface P of the base portion 50 and the placing surface is filled with such a material. Thus, the upright support member 4 is placed horizontally in a stable fashion, and the strength of the ground is increased. Adjustment of the height also becomes possible.

At the opposite side parts of the base portion 50 are formed two through-holes 51 spaced from each other so as to pass from the upper surface to the bottom surface P of the base portion 50. Between each through-hole 51 and the side edge of the corresponding side part of the base portion 50 is formed a slit 51*a* passing from the upper surface to the bottom surface P. These through-holes 51 and the slits 51*a* make connecting parts for connection to the brace members 28 and 30.

Each pair of the upright support members 4 and 6 constituted in the foregoing manner are disposed with a predetermined spacing in a transverse direction, with one end surface 52*a* of the upright portion 52 of one of them being caused to face one end surface 52*a* of the upright portion 52 of the other upright support member. The respective upright support members 4 and 6 are disposed with a predetermined spacing in a longitudinal direction, with one side surface 52*e* of the upright portion 52 being caused to face one side surface 52*d* of the adjacent upright portion 52. As clear from FIG. 1, the upright support members 4 and 6 disposed at the longitudinally opposite ends constitute the corner upright support members of the three-dimensional structure 2. Each pair of the other upright support members 4 and 6 disposed with spacing in the longitudinal direction between the corner upright support members 4 and 6 constitute side upright support members.

Figure 8:
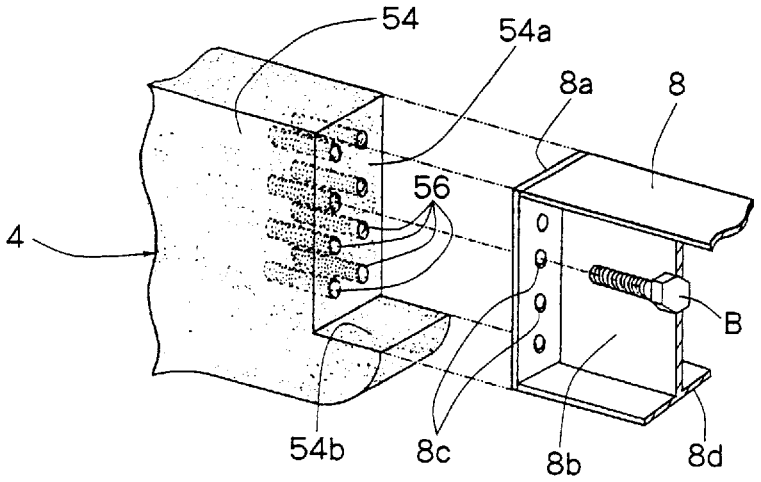
FIG. 8 is an exploded perspective view showing the joint between the upright support member and the transverse beam member.

With reference to FIG. 8 along with FIG. 3, a rectangular connecting plate 8*a* is secured to one end of the transverse beam member 8. At those opposite side parts of the connecting plate 8*a* which are divided by a vertical portion 8*b* of an H-shaped steel, are formed four connecting holes 8*c*. One end of the transverse beam member 8 is coupled detachably to the cantilever beam portion 54 of the upright support member 4 by means of bolts B, with a lower end horizontal portion 8*d* of the H-shaped steel being placed on a horizontal surface 54*b* of the cantilever beam portion 54 of the upright support member 4, and with the connecting plate 8*a* being contacted with an upright surface 54*a* of the cantilever beam portion 54. The other end of the transverse beam member 8 also has substantially the same makeup, and is likewise coupled detachably to the cantilever beam portion 54 of the upright support member 6. Since the cantilever beam portion 54 is formed at each of the upright support members 4 and 6 as described above, the length of the transverse beam member 8 is decreased, achieving increased strength.

With reference to FIG. 9 along with FIG. 3, a rectangular connecting plate 10*a* is secured to one end of the longitudinal beam member 10 that connects together the upper end parts of the upright support members 4. At those opposite side parts of the connecting plate 10*a* which are divided by a vertical portion 10*b* of an H-shaped steel, are formed four connecting holes 10*c* each. One end of the longitudinal beam member 10 is coupled detachably to a side surface 52*d* or 52*e* by means of bolts B, with the connecting plate 10*a* being contacted with the corresponding side surface 52*d* or 52*e*. The other end of the longitudinal beam member 10 also has substantially the same makeup, and is likewise coupled detachably to the side surface 52*e* or 52*d* of another upright support member 4. The other longitudinal beam member 12 is similarly coupled between the upright support members 4. Other longitudinal beam members 14 and 16 are also similarly coupled between the upright support members 6.

With reference to FIG. 3, adjacent upright support members 4 arranged longitudinally are connected separably by the two brace members 28 and 30. Each of the brace members 28 and 30 comprises a rod member square in cross section. At the opposite ends of the brace member 28 are formed circular heads 28*a*, and circular heads 30*a* are formed at the opposite ends of the brace member 30. Into the through-holes 51 of the base portion 50 of the upright support member 4 are fitted from above the heads 28*a* and 30*a* of the corresponding brace members 28 and 30. The slits 51*a* of the through-holes 51 are fitted with the square portion of the rod member. Adjacent upright support members 6 arranged longitudinally are likewise connected separably by the two brace members 36 and 38 having substantially the same makeup as do the two brace members 28 and 30.

The lower ends of the upright support members 4 adjacent to each other, and the center of the lower end of the longitudinal beam member 10 connecting them together are coupled separably by the brace members 24 and 26. Each of the brace members 24 and 26 comprises a rod member circular in cross section. Connecting plates 24*a* and 24*b* are secured to the opposite ends of each brace member 24, while connecting plates 26*a* and 26*b* are secured to the opposite ends of each brace member 26. The connecting plates 24*a* and 26*a* at the upper ends of the brace members 24 and 26 are coupled detachably to the center of the lower end of the corresponding longitudinal beam member 10. Whereas the connecting plates 24*b* and 26*b* at the lower ends of the brace members 24 and 26 are each coupled detachably to the connecting part provided at the lower end of the corresponding upright support member 4.

The lower ends of the upright support members 6 adjacent to each other, and the center of the lower end of the longitudinal beam member 16 connecting them together are coupled separably by the brace members 32 and 34. The brace members 32 and 34 have substantially the same makeup as do the brace members 24 and 26. Thus, the coupling of each of the brace members 32 and 34 to the corresponding longitudinal beam member 16 and the upright support member 6 is performed in the same manner as stated above.

Figure 10:
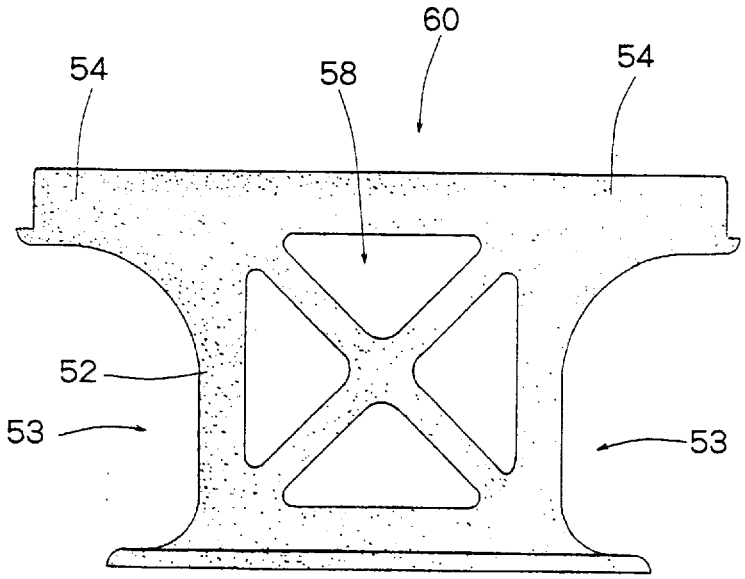
FIG. 10 is a front view showing another embodiment of the upright support member.

The upright support member illustrated in FIG. 10 is an upright support member 60 disposed between the upright support members 4 and 6 arranged at the transversely opposite ends of a three-dimensional structure in which three or more of the upright support members are arranged with spacing in the transverse direction. At upper end parts of the opposite end surfaces of an upright portion 52 of the upright support member 60 are integrally formed cantilever beam portions 54 each extending outwardly from the end surface. To the front end of each cantilever beam portion 54 is detachably coupled one corresponding end of the transverse beam member 8. The other constitution is substantially the same as the upright support member 4 shown in FIG. 4 to FIG. 7, and thus its explanation will be omitted.

Figure 11:
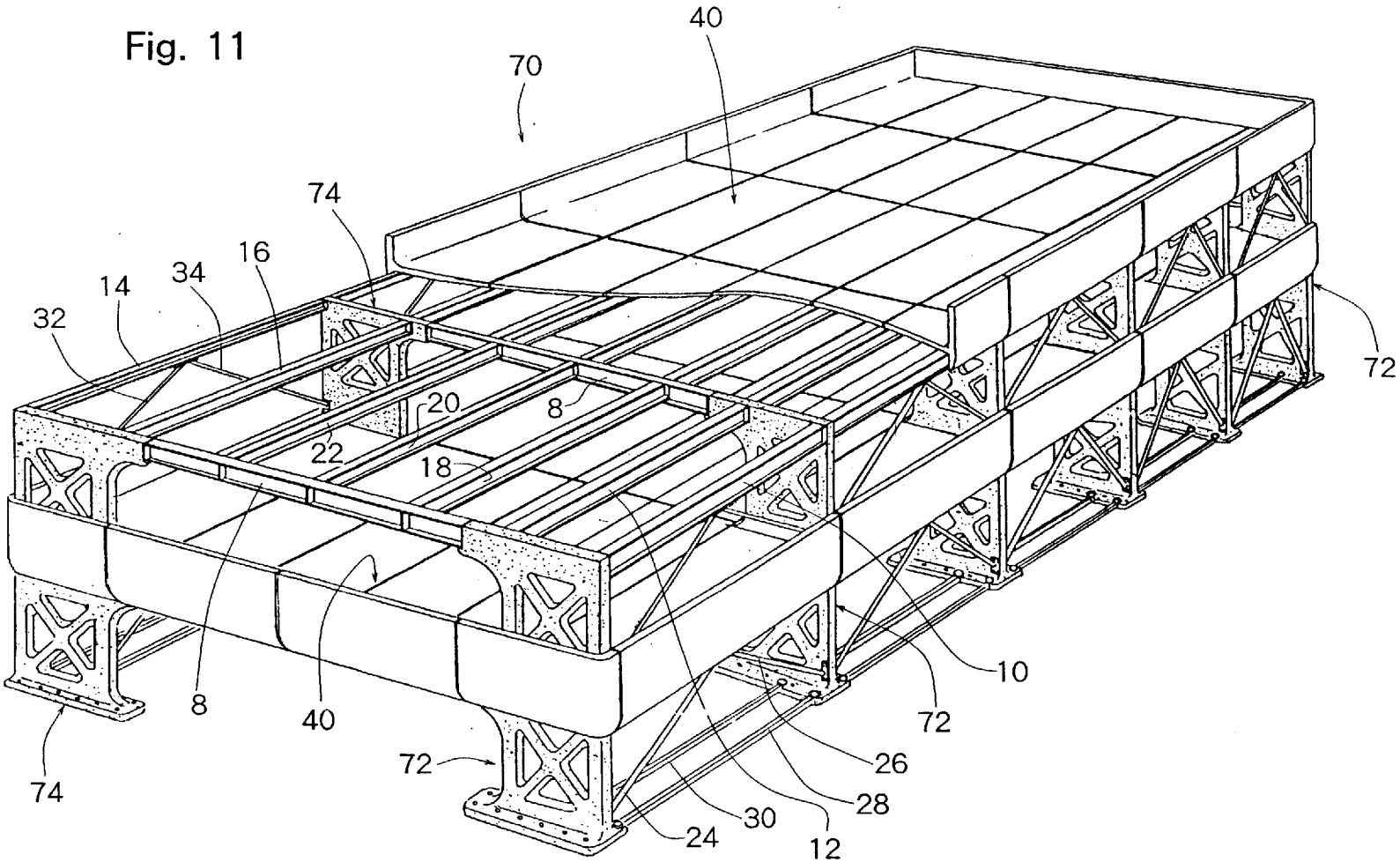
FIG. 11 is a perspective view showing, in a partly broken away manner, another embodiment of a three-dimensional place-on type assemblable structure concerned with the present invention.

FIG. 11 shows a three-dimensional structure 70, another embodiment of the three-dimensional structure 2 illustrated in FIG. 1 and FIG. 2. This structure 70 is a three-story one having two of the floors 40 with spacing in an up-and-down direction. As will be understood easily by comparison between FIG. 2 and FIG. 11, the three-dimensional structure 70 is shaped like two of the three-dimensional structures 2 piled up. Upright support members 72 and 74 are used for the three-dimensional structure 70. These upright support members 72 and 74 have substantially the same makeup.

Figure 12:
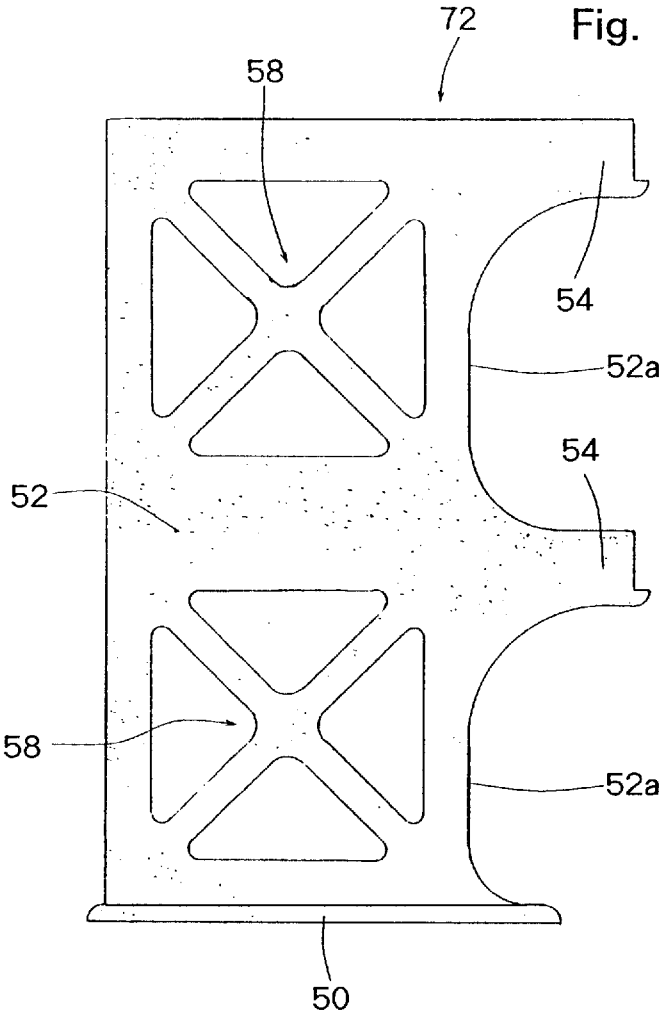
FIG. 12 is a front view of an upright support member for use in the structure shown in FIG. 11.

FIG. 12 shows an upright support member 72. As will be understood easily by comparison with the upright support member 4 illustrated in FIG. 4 to FIG. 7, the upright support member 72 is shaped like the upright portion 52 laid on the upright support member 4. The height of the upright portion 52 is defined so as to suit a three-story structure, and the same cantilever beam portion 54 as described is integrally formed at each of an upper end part and an up-and-down direction middle part of one end surface 52*a* of the upright portion 52. At an upper position and a lower position of the upright portion 52 are formed diagonal bracing portions 58 as described previously. That is, the basic makeup of the upright support member 72 (and 74) is substantially the same as that of the upright support member 4. The cantilever beam portions 54 of the upright support members 72 and 74 adjoining in the transverse direction are connected together by the transverse beam member 8. The upper ends and middle parts of the mutually facing side surfaces of the upright support members 72 adjoining in the longitudinal direction, as well as the upper ends and middle parts of the mutually facing side surfaces of the upright support members 74 adjoining in the longitudinal direction are connected together by the same longitudinal beam members as described earlier (see FIG. 11). The transverse beam members 8 are also connected together by the same longitudinal beam members as described earlier. At the up-and-down direction middle part of each of the upright support members 72 and 74 is formed the floor 40 for a two-story structure, whereas the floor 40 for a three-story structure is formed at the upper end parts of each of the upright support members 72 and 74. The other makeup is substantially the same as that of the structure 2. If the structure 70 is used as a car parking lot, an inclined passage structure is installed between the floor 40 as the second floor and the ground surface, and an inclined passage structure is also installed between the floor 40 as the second floor and the floor 40 as the third floor or between the floor 40 as the third floor and the ground surface, although they are not shown.

Figure 13:
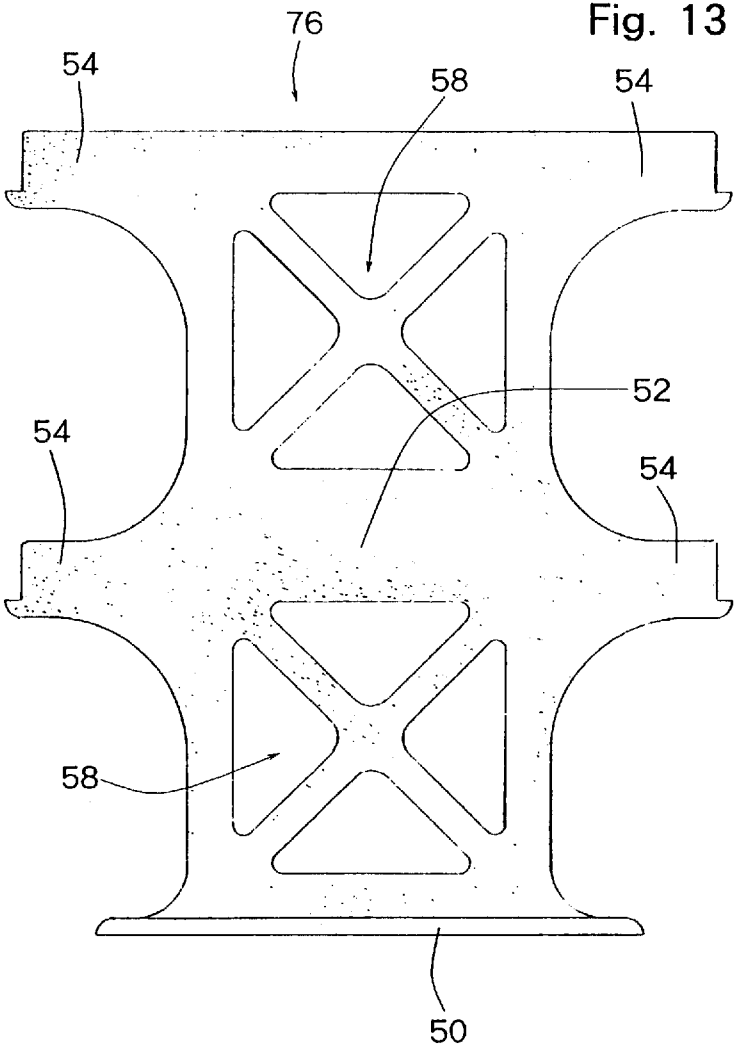
FIG. 13 is a front view showing another embodiment of the upright support member illustrated in FIG. 12.

The upright support member illustrated in FIG. 13 is an upright support member 76 disposed between the upright support members 72 and 74 arranged at the transversely opposite ends of a three-dimensional structure (not shown) in which three or more of the upright support members are arranged with spacing in the transverse direction. At upper end parts and middle part of the opposite end surfaces of the upright portion 52 of the upright support member 76 illustrated in FIG. 13 are integrally molded cantilever beam portions 54 each extending outwardly from the end surface. To the front end of each cantilever beam portion 54 is detachably coupled one corresponding end of the transverse beam member 8. The other makeup is substantially the same as that of the upright support member 72 shown in FIG. 12. The upright support members 76 are arranged in plural numbers in the longitudinal direction as well, and have substantially the same makeup.

Figure 14:
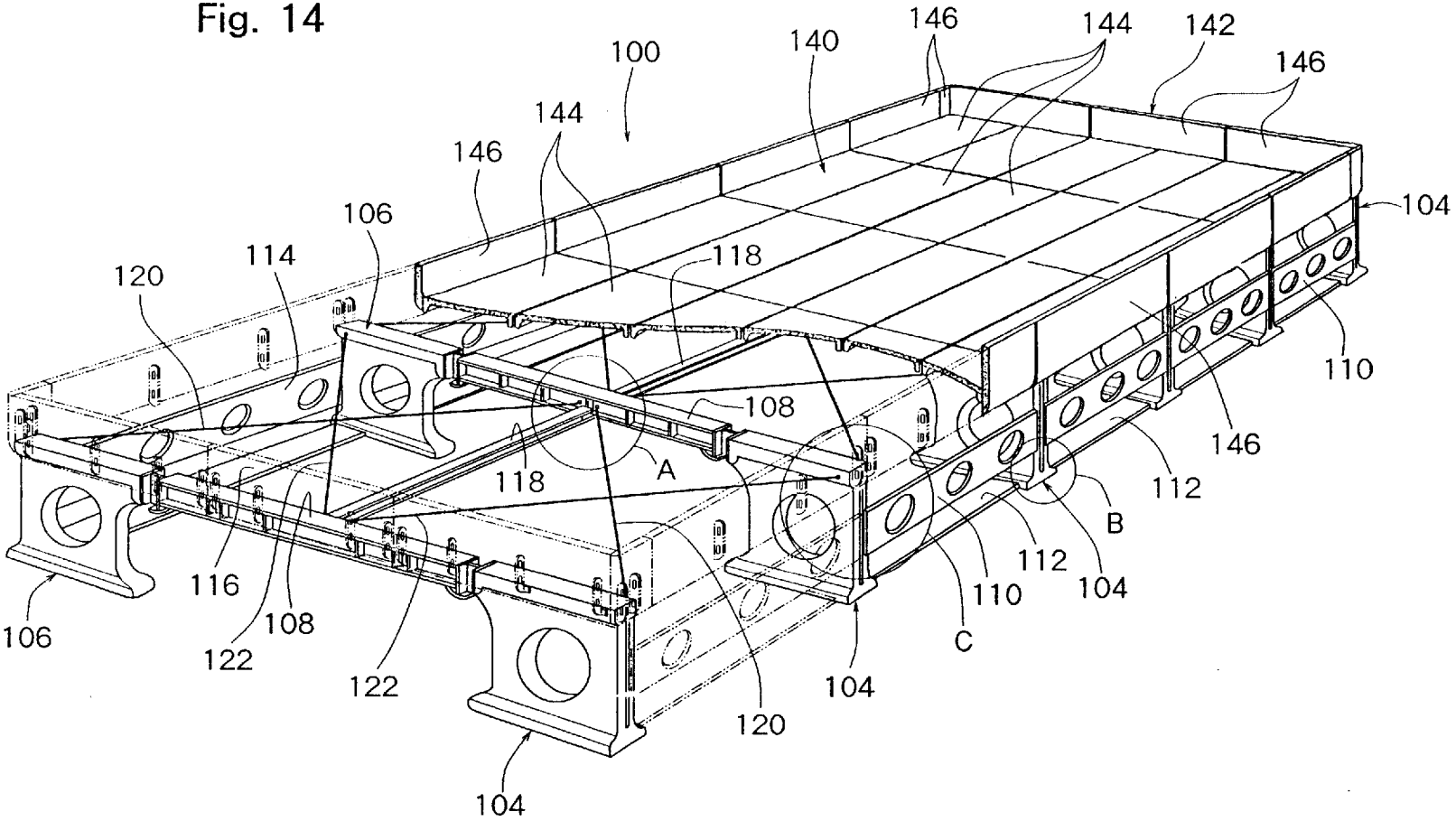
FIG. 14 is a perspective view showing, in a partly broken away manner, still another embodiment of a three-dimensional place-on type assemblable structure concerned with the present invention.

FIG. 14 shows a three-dimensional structure 100, still another embodiment of the three-dimensional structure 2 illustrated in FIG. 1 and FIG. 2. The basic makeup and layout of the three-dimensional structure 100 are substantially the same as those of the three-dimensional structure 2. The outline of the three-dimensional structure 100 will be described first. The three-dimensional structure 100 is assembled dissociably in a rectangular form as a whole, and is placed on a substantially flat surface which may be the ground surface. The numerals 104 and 106 represent upright support members each molded integrally from concrete. The manner of transverse and longitudinal arrangement of the upright support members 104 and 106 are substantially the same as those of the upright support members 4 and 6. The upper end surfaces, facing each other transversely, of the upright support members 104 and 106 are separably connected by one transverse beam member 108 (constituting beam means). The upright support members 104 are separably connected by a side brace member 110 and a base brace member 112 (constituting connecting means). The upright support members 106 are separably connected by a side brace member 114 and a base brace member 116. Longitudinally central portions of the transverse beam members 108 are separably connected by one longitudinal beam member 118. In transverse opposite side regions of each of the longitudinal beam members 118, the transverse beam member 108 and upright support members 104 facing in the longitudinal direction, and the transverse beam member 108 and upright support members 106 facing in the longitudinal direction, are separably connected together by two brace rods 120 and 122 that cross each other in an X shape when viewed from above. Each of the transverse beam members 108 and the longitudinal beam members 118 is formed of an H-shaped steel.

The upper surfaces of the upright support members 104, 106 and the transverse beam members 108 are positioned on substantially the same horizontal plane. The upper surface of each of the transverse beam members 108 and the upper surface of each of the upright support members 104, 106 connected together by the transverse beam members 108 form transversely extending horizontal placing surfaces. On each of the horizontal placing surfaces is separably mounted the floor 140 as the second floor. At a substantially rectangular peripheral edge portion of the floor 140 is provided an upright fence 142. The floor 140 is composed of a plurality of floor panel members 144. The upright fence 142 is composed of a plurality of side panel members 146.

Figure 15:
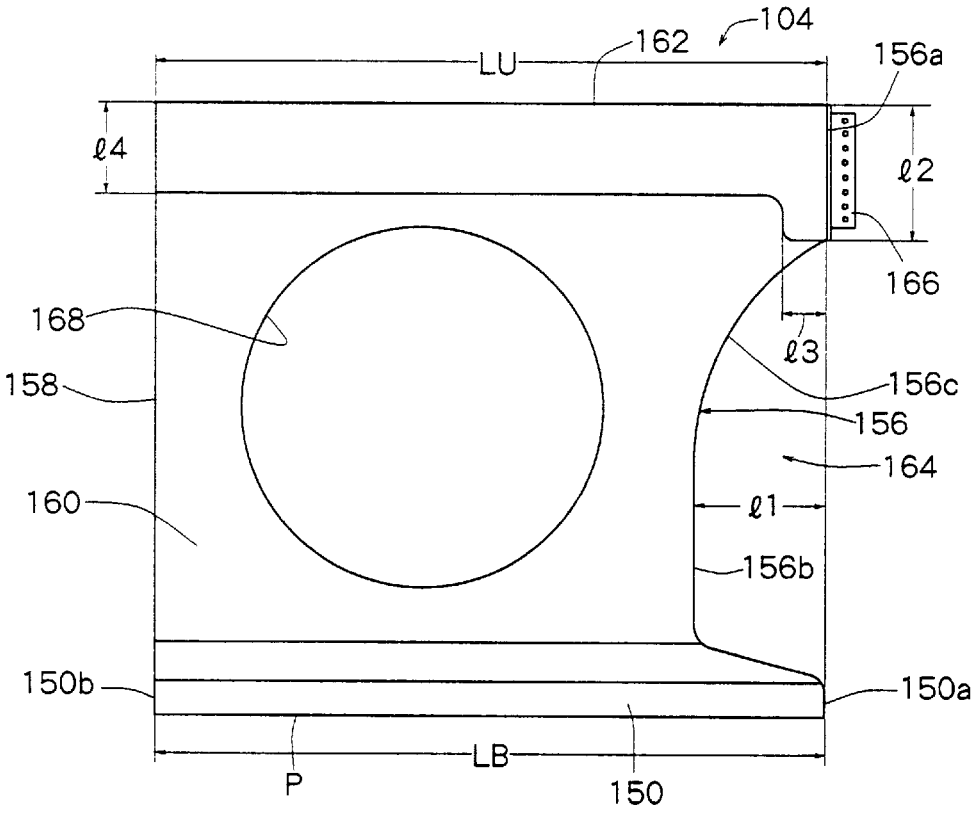
FIG. 15 is a front view of an upright support member for use in the structure shown in FIG. 14.
Figure 16:
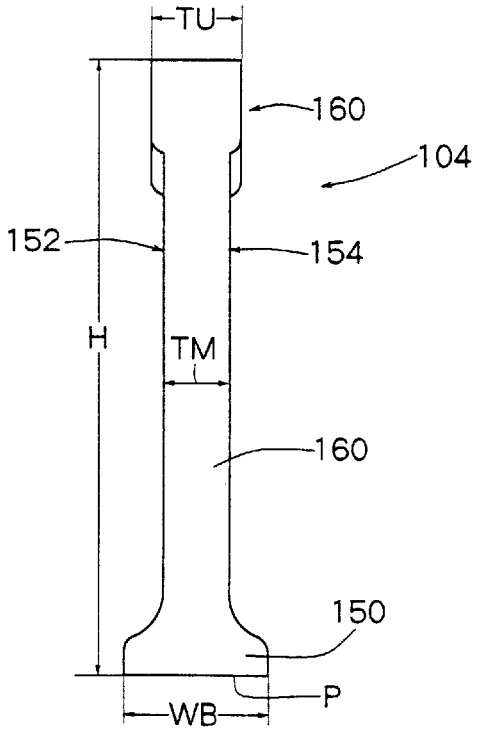
FIG. 16 is a left side view of FIG. 15.
Figure 17:
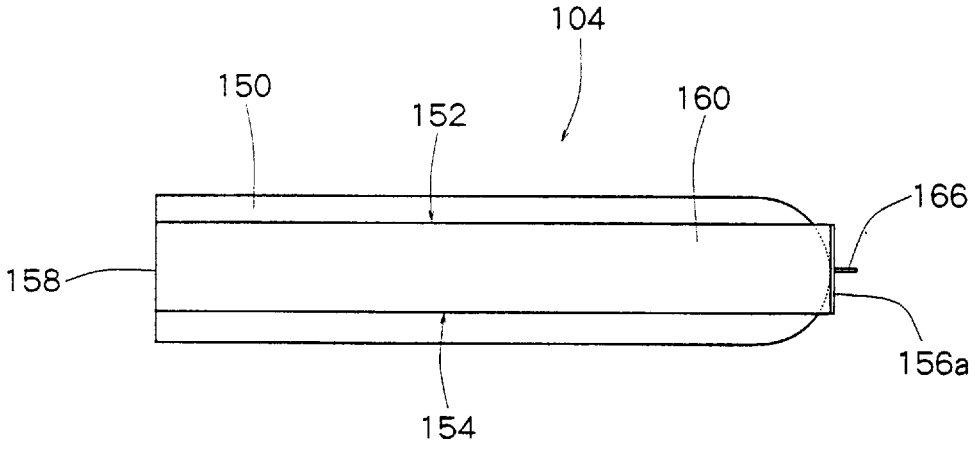
FIG. 17 is a plan view of FIG. 15.

Next, the upright support members 104 and 106 will be described with reference to FIG. 15 to FIG. 17. Since the upright support members 104 and 106 have substantially the same makeup, only the upright support member 104 will be explained. The upright support member 104 includes a base portion 150 extending horizontally for a predetermined length, LB, with a predetermined width, WB, and being to be placed on the aforementioned surface; and an upright portion 160 extending substantially vertically upwardly from the base portion 150, and having opposite side surfaces 152 and 154 which define the widthwise thickness TM of the upright portion 160, and opposite end surfaces 156 and 158 which define its horizontal length. The upright portion 160 has a flat and horizontal upper surface 162. The base portion 150 is in a slender form when viewed from the top, and its bottom surface P is a flat horizontal surface.

An upper end part of one end surface 156 of the upright portion 160 makes a vertical surface 156*a*. One end surface 150*a* of the base portion 150 is positioned on an extension of the vertical surface 156*a*. The other end surface 158 of the upright portion 160 and the other end surface 150*b* of the base portion 150 are positioned on the same vertical plane. At a lower part of the one end surface 156 of the upright portion 160, excluding the vertical surface 156*a*, there is formed a recess 164 concaving by a length 11, from each of the vertical surface 156*a* and the one end surface 150*a* of the base portion 150 toward the other end surface 158. A lower part of the recess 164 makes a vertical surface 156*b*, and the upper end of the vertical surface 156*b* and the lower end of the vertical surface 156*a* are connected together by a curved surface 156*c*. At the vertical surface 156*a* of the upright portion 160 is integrally formed a gusset plate 166 which projects vertically outwardly from this surface. The upright portion 160 has the thickness TM, but its upper end part has a thickness, TU, larger than that. The opposite side surfaces 152 and 154 of the upright portion 160 comprise vertical surfaces which are parallel to each other at any thickness parts of the upright portion 160. At a nearly central part of the upright portion 160 is formed a circular through-hole 168. The upright support member 104 is integrally molded from concrete, and has reinforcements disposed at its inside important points. The width, WB, of the base portion 150 is defined to be greater than the thicknesses TM and TU of the upright portion 160.

Each pair of the upright support members 104 and 106 constituted in the foregoing manner are disposed with a predetermined spacing in a transverse direction, with the one end surface 156 of the upright portion 160 of one of them being caused to face the one end surface 156 of the upright portion 160 of the other of them. The upright support members 104 and the upright support members 106, respectively, are disposed with a predetermined spacing in a longitudinal direction, with the one side surface 152 of the upright portion 160 thereof being caused to face the one side surface 154 of the adjacent upright portion 160. As clear from FIG. 14, the upright support members 104 and 106 disposed at the longitudinally opposite ends constitute the corner upright support members of the three-dimensional structure 100. Each pair of the other upright support members 104 and 106 disposed with spacing from one another in the longitudinal direction between the corner upright support members 104 and 106 constitute the side upright support members.

Figure 18:
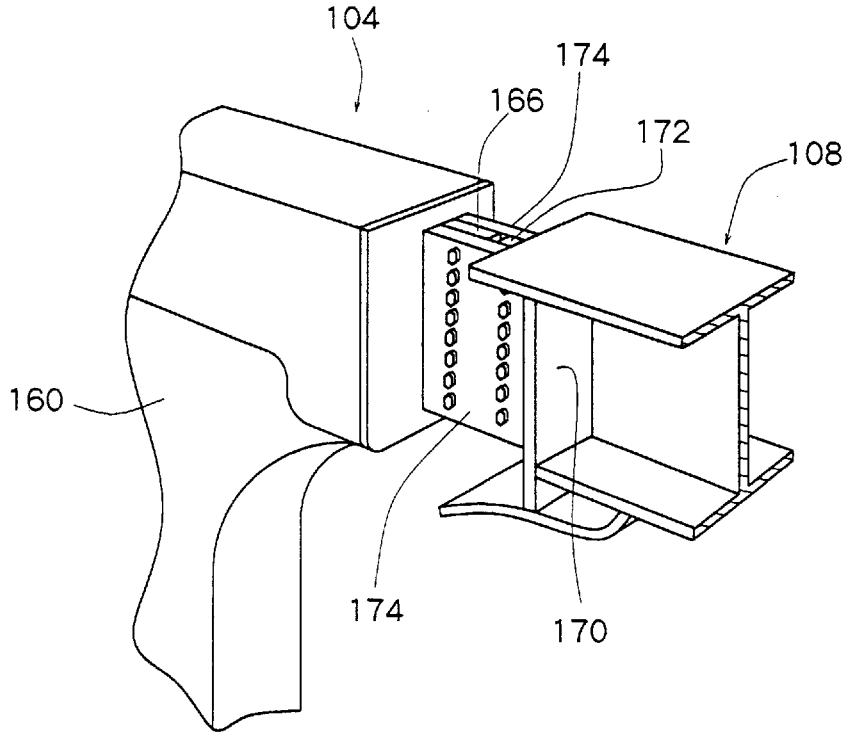
FIG. 18 is an enlarged perspective view showing the joint between the upright support member and the transverse beam member.

With reference to FIG. 18, a vertically extending rectangular plate 170 is secured to one end of the transverse beam member 108, and a gusset plate 172 projecting vertically outwardly from the vertical surface of the plate 170 is integrally secured to this surface. The gusset plate 166 of the upright portion 160 of the upright support member 104 and the gusset plate 172 at one end of the transverse beam member 108 are separably connected together via two connecting plates 174, whereby the one end of the transverse beam member 108 is connected to the upper end surface 156*a* of the one end surface 156 of the upright support member 104. The other end of the transverse beam member 108 also has substantially the same makeup, and is likewise separably connected to the upper end surface 156*a* of the one end surface 156 of the upright support member 106. Thus, plural pairs of the upright support members 104 and 106 connected together by the transverse beam member 108 are formed.

Figure 19:
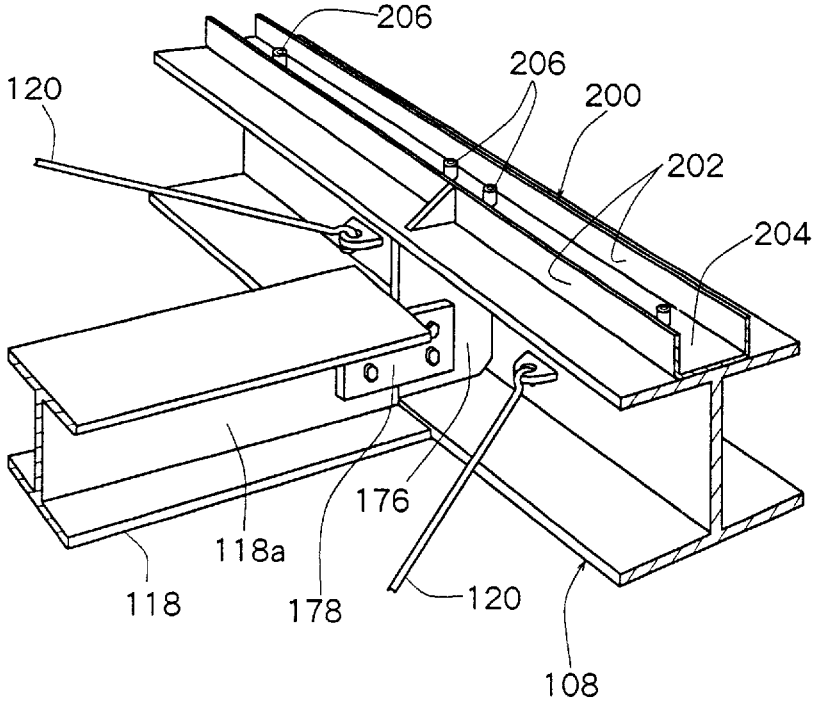
FIG. 19 is an enlarged view of the A region in FIG. 14.

With reference to FIG. 19, gusset plates 176 are secured to the opposite sides of a longitudinally central part of the transverse beam member 108. One of the gusset plates 176 is separably connected to a vertical portion 118*a* at one end of the longitudinal beam member 118 via two connecting plates 178, whereby the one end of the longitudinal beam member 118 is connected to the transverse beam member 108. Similarly, the other end of the longitudinal beam member 118 is separably connected to another transverse beam member 108. One end of each of the brace rods 120 is detachably coupled to the transverse beam member 108, while the other end thereof (not shown) is separably coupled to one side surface of the upper end part of the upright support member 104 or 106. Coupling of the brace rods 122 is carried out in the same manner. The brace rods 120 and 122 each have a turnbuckle (not shown).

Figure 20:
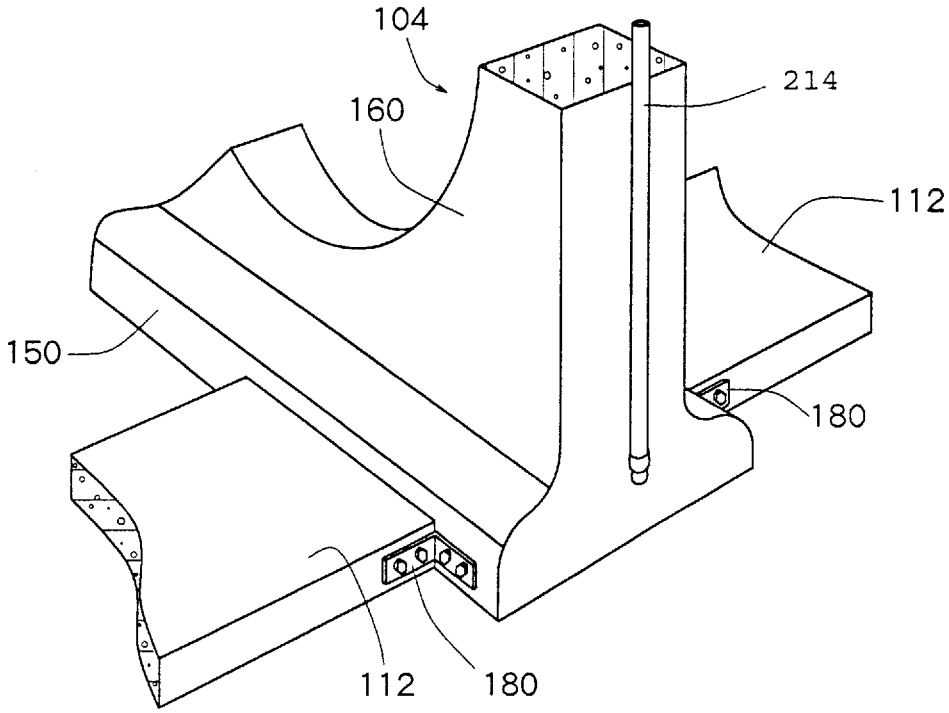
FIG. 20 is an enlarged view of the B region in FIG. 14.

By reference to FIG. 20, the base brace member 112 is substantially rectangular, and is molded integrally from concrete. One end of the base brace member 112 is connected separably to one side part of the base portion 150 of the upright support member 104 via two L-shaped connecting plates 180. Whereas the other end thereof (not shown) is likewise connected separably to one side part of the base portion 150 of another upright support member 104. The base brace member 116 also has substantially the same makeup, and is similarly connected separably between the upright support members 106. The base brace members 112 and 116 can function as stoppers for the wheels of an automobile.

Figure 21:
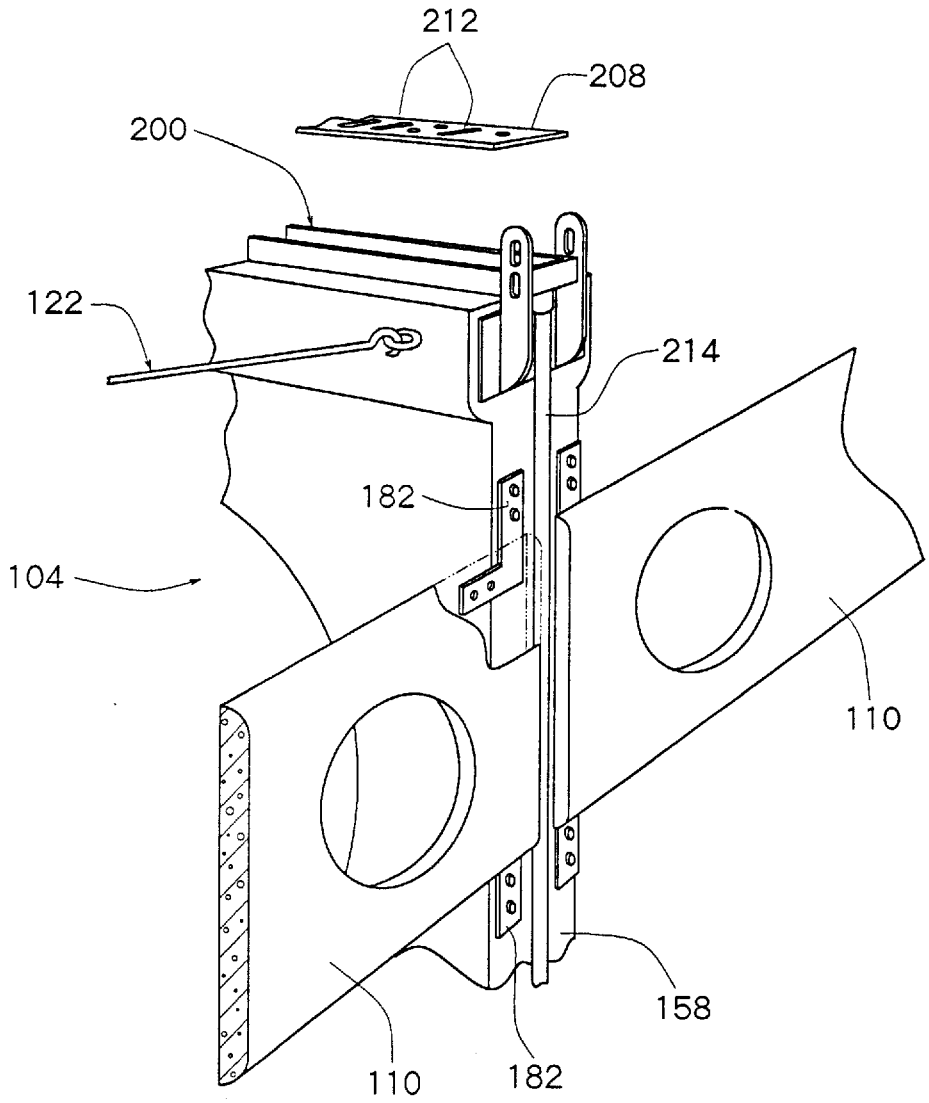
FIG. 21 is an enlarged view of the C region in FIG. 14.

By reference to FIG. 21, the side brace member 110 is substantially rectangular, and is molded integrally from concrete. One end of the side brace member 110 is connected separably to the other end surface 158 of the upright support member 104 via two L-shaped connecting plates 182. Whereas the other end thereof (not shown) is likewise connected separably to the other end surface 158 of another upright support member 104. The side brace member 114 also has substantially the same makeup, and is similarly connected separably between the upright support members 106.

Figure 22:
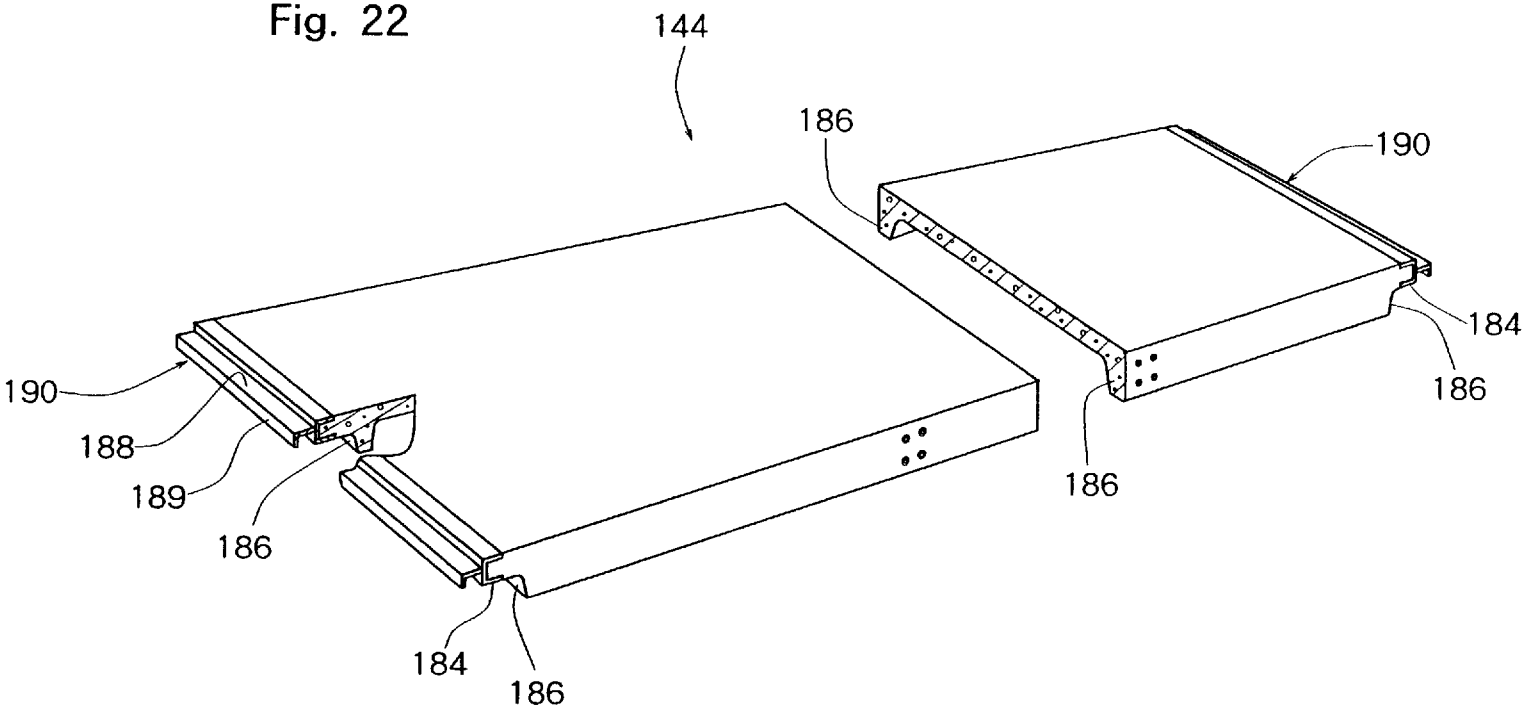
FIG. 22 is a perspective view, partly broken away, of a floor panel member for use in the three-dimensional structure shown in FIG. 14.

With reference to FIG. 22, the floor panel member 144 is substantially rectangular in its plan view, has a flat upper surface, and is integrally molded from concrete. At longitudinally opposite end portions of the lower surface of the floor panel member 144 are formed horizontal lower surfaces 184 each extending from one side to the other side of that end portion. The floor panel member 144 is also provided with flange portions 186 each extending downwardly from the inner side edge of each of the horizontal lower surfaces 184. The flange portion 186 is formed annularly continuously at a peripheral edge portion, excluding each of the horizontal lower surfaces 184, of the lower surface of the floor panel member 144. At the opposite end surfaces of the floor panel member 144 are integrally provided connecting plate members 190 each comprising a horizontal portion 188 extending outwardly from that surface, and an engaging portion 189 extending vertically downwardly from the front end of the horizontal portion 188.

Figure 23:
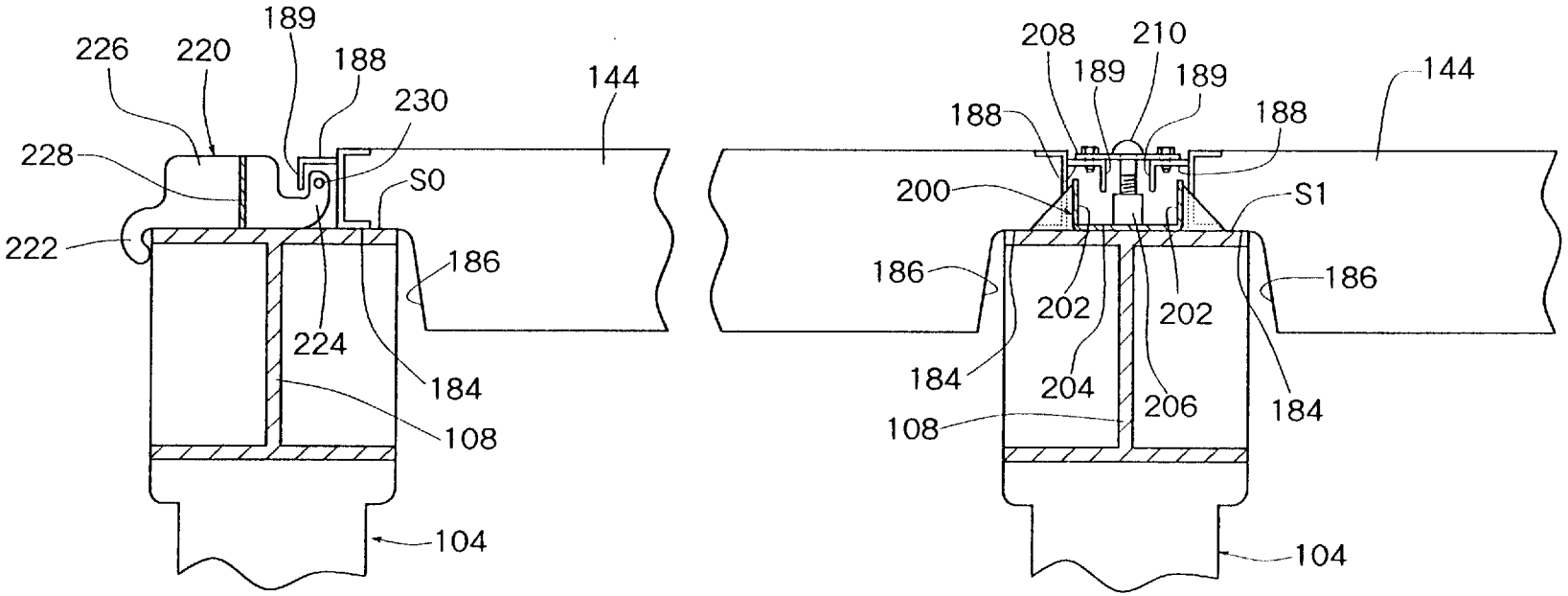
FIG. 23 is a view, partly broken away, showing the state of connection between the transverse beam member and the floor panel member used in the three-dimensional structure of FIG. 14, as viewed in the horizontally transverse direction in FIG. 14

With reference to FIG. 23, transversely extending horizontal placing surfaces S (S0, S1, and so forth) are formed by the upper surface of each of the transverse beam members 108 and the upper surfaces of the upright support members 104 and 106 that are connected together by the transverse beam members 108, as have been described. As will be clear from the above-mentioned layout of the three-dimensional structure 100, the horizontal placing surfaces S are positioned on substantially the same horizontal plane, and are formed in a plural number (the same number as the number of the transverse beam members 108) with spacing in the longitudinal direction. One of the horizontal lower surfaces 184 of the floor panel member 144 is placed on one of adjacent horizontal placing surfaces S, while the other horizontal lower surface 184 is placed on the other horizontal placing surface S. In FIG. 23, the left-handed horizontal placing surface S0 is positioned at one end of the three-dimensional structure 100, while the right-handed horizontal placing surface S1 is positioned adjacently.

First, an explanation will be offered for the makeup of the joint between the right-handed horizontal placing surface S1 and the two floor panel members 144 placed thereon. On the horizontal placing surface S1 are placed one end surface of the floor panel member 144 and that of another floor panel member 144 so as to face each other with a gap provided therebetween. In the gap on the horizontal placing surface S1 is secured a channel member 200 extending continuously so as to cover the upright support member 104, the transverse beam member 108, and the upright support member 106. The channel member 200 comprises a pair of vertical portions 202 facing with spacing in the longitudinal direction, and a horizontal bottom portion 204 connecting the lower ends of the vertical portions 202. The horizontal bottom portion 204 is secured to the horizontal placing surface S1. To the horizontal bottom portion 204 are fixed a plurality of upright cylindrical nut members 206 each having an internal thread formed on the inner peripheral surface (see FIG. 19).

The respective horizontal portions 188 of the floor panel member 144 are positioned with spacing above the corresponding vertical portions 202 of the channel member 200, while the respective engaging portions 189 are positioned with a gap formed with respect to the inner side surface of the corresponding vertical portion 202. A slender rectangular plate 208 (constituting a cover plate means) extending along the channel member 200 is disposed across the upper surfaces of the mutually facing horizontal portions 188, and is bolted separably to the respective horizontal portions 188. The plate 208 is also connected separably to each of the nut members 206 by a bolt 210. Thus, the opposite end portions of each floor panel member 144 are connected separably to the horizontal placing surface S1. In this condition, the flange portion 186 of each floor panel member 144 is positioned to face, with a gap, one corresponding side surface of the upper end part of the upright support member 104 or 106, or one corresponding side surface of the upper end part of the transverse beam member 108. The aforementioned positional relationship between the engaging portion 189 and the corresponding vertical portion 202, and the above positional relationship between the flange portion 186 and the corresponding side surface, function to restrain a possible longitudinal relative movement of some magnitude occurring between the floor panel member 144 and the corresponding upright support members 104, 106, or the transverse beam member 108, and to enhance the relationship of mutual connection.

With reference to FIG. 21 along with FIG. 23, the plate 208 is provided with a plurality of through-holes 212. At least one transversely end part of the channel member 200 protrudes transversely from the upright support member 104 or 106, and a drainage means including a drainage hole (not shown) is formed at the horizontal bottom portion 204 in the protruding one end part. The drainage means includes a drainage pipe 214 extending vertically along the other end surface 158 of the upright support member 104 or 106. Fluids such as rainwater flowing into the channel member 200 through the through-holes 212 are discharged smoothly through the drainage pipe 214.

Next, FIG. 23 will be referred to again to describe the relation between the left-handed horizontal placing surface S0 and the floor panel member 144 placed thereon. On the horizontal placing surface S0 are provided a plurality of stopper units 220 (constituting stopper means). Each of the stopper units 220 includes a plurality of first hooks 222 extending longitudinally outwardly from the horizontal placing surface S0 and then bending downwardly, and a plurality of second hooks 224 extending longitudinally inwardly on the horizontal placing surface S0 and then bending upwardly. The hooks 222 and 224 are formed integrally with the opposite ends of a plurality of plates 226 extending in a width direction (longitudinal direction) of the horizontal placing surface S0 and arranged with spacing in a longitudinal direction (transverse direction) of the horizontal placing surface S0. The plates 226 are integrally secured together via a plurality of connecting plates 228 extending longitudinally of the horizontal placing surface S0. The hooks 224 are integrally connected together via a single rod 230 (passing through the respective hooks 224) extending longitudinally of the horizontal placing surface S0. The engaging portion 189 of the floor panel member 144 placed on the horizontal placing surface S0 is engaged with the hook 224 with spacing. The flange portion 186 of the floor panel member 144 is positioned to face, with a gap, one corresponding side surface of the upper end part of the upright support member 104 or 106, or one corresponding side surface of the upper end part of the transverse beam member 108. This makeup functions to restrain a possible longitudinal relative movement of some magnitude occurring between the floor panel member 144 and the corresponding upright support members 104, 106, or the transverse beam member 108, and to enhance the mutually connecting relationship. Each of the stopper units 220 may be secured to, or placed on, the horizontal placing surface S0.

Figure 24:
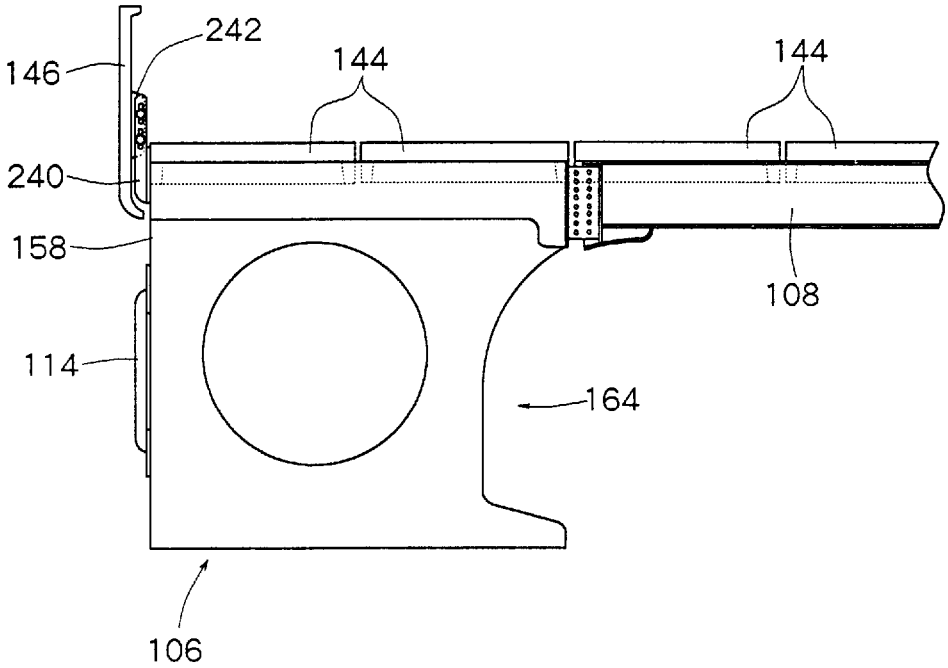
FIG. 24 is a view, partly omitted, showing the state of connection between the upright support member and the floor panel member used in the three-dimensional structure of FIG. 14, as viewed in the horizontally longitudinal direction in FIG. 14.

With reference to FIG. 24, a plurality of vertically upwardly extending brackets 240 are mounted on an upper end part of the other end surface 158 of the upright support member 106. The side panel member 146, nearly rectangular when viewed from the side (left side in FIG. 24) and curved at its lower end, is molded integrally from concrete. On the inner side surface of the side panel member 146 are mounted a plurality of brackets 242. The brackets 242 of the side panel member 146 are separably connected to the corresponding brackets 240 of the upright support member 106, whereby the side panel member 146 is supported by the upright support member 106. Similar brackets 240 are provided on the transverse beam members 108 located at the longitudinally opposite ends of the three-dimensional structure 100, the same sites of other upright support members 106 and 104, and one side surface of each of the floor panel members 144 located at the transversely opposite ends of the three-dimensional structure 100. Other side panel members 146 are separably supported in the same manner by these brackets 240.

Next, a preferred embodiment of the three-dimensional structure 100 shown in FIG. 14 will be described. With reference to FIG. 14 to FIG. 17, a pair of corner upright support members 104 and 106 are disposed at each of the opposite ends in the longitudinal direction. Between these two pairs of corner upright support members 104 and 106 are disposed four pairs of side upright support members 104 and 106. The corner and side upright support members 104 and 106 having substantially the same makeup have the following dimensions.

The length LB from the one end surface 150*a* to the other end surface 150*b* of the base portion 150, and the length LU from the one end surface 156*a* to the other end surface 158 of the upper end part of the upright portion 160 are each 3,000 mm. The height H from the bottom surface P of the base portion 150 to the upper surface of the upright portion 160 is 2,700 mm. The width WB of the base portion 150 is 650 mm. The thickness of the upper end part of the upright portion 160 is 400 mm. The thickness TM of the upright portion 160, excluding its upper end part, is 300 mm. The depth l1 from the vertical surface common to the one end surface 156*a* of the upright portion 160 and the one end surface 150*a* of the base portion 150 (each surface defining the one end surface of the upright support member) to the vertical surface 156*b* of the recess 164 is 600 mm. The diameter of the through-hole 168 is 1,600 mm.

The region involving the thickness TU of the upper end part of the upright portion 160 comprises a region defined by a downward length, l2, from the upper surface of the upright portion 160, and a length, l3, from the one end surface 156*a* toward the other end surface 158; and a region defined by a downward length, l4, from the upper surface of the upright portion 160, and a length remaining after subtracting the length l3 from the length LU. The length l2 is 600 mm, the length l3, 200 mm, and the length l4, 400 mm.

Each of the transverse beam members 108 is composed of an H-shaped steel. The width and height of the H-shaped steel constituting the transverse beam member 108 are each 400 mm, and its entire length is 8,800 mm. The transverse spacing between the one end surface 156*a* of the upright portion 160 of the upright support member 104 and the one end surface 156*a* of the upright portion 160 of the upright support member 106, which are connected together by the transverse beam member 108, is 9,000 mm. The longitudinal distance between the widthwise center of the upright support member 104 and that of the adjacent upright support member 104 is 5,500 mm. The longitudinal distance between the widthwise center of the upright support member 106 and that of the adjacent upright support member 106 is 5,500 mm. Each of the longitudinal beam members 118 is composed of an H-shaped steel. Its width is 100 mm, its height, 200 mm, and its entire length, 5,090 mm. Each of the brace rods 120 and 122 comprises a steel round bar with a turnbuckle, and its diameter is 13 mm.

Each of the side brace members 110 and 114 has a width of 1,300 mm, a length of 5,400 mm, and a thickness of 90 mm. Each of the base brace members 112 and 116 has a width of 650 mm, a length of 4,830 mm, and a thickness of 125 mm. Each of the floor panel members 144 is 1,480 mm wide, and 5,360 mm long. Its entire thickness, including the flange portion 186, is 300 mm. The thickness of its site, surrounded by the flange portion 186, is 75 mm. The width (thickness) of each of the side panel members 146, excluding those at the corners, is 1,300 mm, and its length is 5,475 mm. The side brace members, the base brace members, the floor panel members and the side panel members are each molded integrally from concrete.

While the embodiments of the three-dimensional place-on type assemblable structure according to the present invention have been described, it should be understood that the invention is not limited to these embodiments, and various changes or modifications are possible without departing from the scope and spirit of the invention.

The three-dimensional place-on type assemblable structure of the present invention can give a much larger usable space than that of a conventional pillar-structured three-dimensional structure in the same area of installation. This leads to increased convenience. Moreover, not only area increases in the horizontally transverse and longitudinal directions, but vertically upward expansion can be achieved easily at relatively low costs. Furthermore, since its constituent members have been markedly simplified, their production is performed even more efficiently. Thus, the assembly time for the whole three-dimensional structure is markedly shortened, and its construction cost is further reduced.

What we claim is:

1. A three-dimensional structure dissociably assemblable and placeable on a substantially flat surface, the structure comprising:

a plurality of upright support members each integrally molded from concrete, the upright support members each including a base portion extending horizontally over a predetermined length with a predetermined width for resting on the flat surface; and an upright portion extending substantially vertically upwardly from the base portion, the upright portion having opposite side surfaces defining a widthwise thickness and opposite end surfaces defining a horizontal length, wherein the predetermined width of the base portion is wider than the widthwise thickness of the upright portion, a beam means transversely connecting the plurality of upright support members, and a connecting means longitudinally connecting the plurality of upright support members; and wherein the beam means are each disposed so as to connect together upper end parts of the one end surface of the upright portion of each of the upright support members and the one end surface of the upright portion of another of the upright support members, the former one end surface and the latter one end surface being caused to face each other in the horizontally transverse direction, horizontally transversely extending horizontal placing surfaces are formed by the upper surfaces of the beam means and the upper surfaces of the upright portions that are connected together by the beam means, a plurality of floor panel members each substantially rectangular in a plan view and integrally molded from concrete, the floor panel members being connected to the upper surfaces of the beam means and the upper surfaces of the upright portions that are connected together by the beam means, and the floor panel members being adjacent to each other with spacing in the horizontally longitudinal direction, at horizontally longitudinally opposite end portions of each of the floor panel members are formed a horizontal lower surface to be placed on the corresponding horizontal placing surface, and a flange portion extending downwardly from an inner side edge of the horizontal lower surface, and the horizontal lower surface of each of the floor panel members is placed on the corresponding horizontal placing surface, a flange portion of each of the floor panel members is positioned to face, with a gap, one corresponding side surface of the upper end part of the upright portion of each of the upright support members, or one corresponding side surface of an upper end part of the beam means.

2. The three-dimensional structure of claim 1 wherein stopper means are disposed on each of the horizontal placing surfaces positioned at the opposite ends in the horizontally longitudinal direction, each of the stopper means includes a plurality of first hooks extending horizontally longitudinally outwardly from each of the horizontal placing surfaces and then bending downwardly, and a plurality of second hooks extending horizontally longitudinally inwardly on each of the horizontal placing surfaces and then bending upwardly, and at one end surface of each of the floor panel members placed on each of the horizontal placing surfaces positioned at the opposite end portions is provided a connecting plate member comprising a horizontal portion extending horizontally longitudinally outwardly above the upper end of each of the second hooks, and an engaging portion extending vertically downwardly at the front end of each of the horizontal portions so as to engage each of the second hooks with a gap.

3. The three-dimensional structure of claim 1 wherein on each of the horizontal placing surfaces, other than the horizontal placing surfaces positioned at the opposite ends in the horizontally longitudinal direction, are placed one end surface of each of the floor panel member and that of another floor panel member so as to face each other with a gap provided therebetween, in the gap on each of the other horizontal placing surfaces is disposed a channel member extending continuously over one of to the other of the upright support members and comprising a pair of vertical portions facing each other with spacing in the horizontally longitudinal direction, and a horizontal bottom portion connecting the lower ends of the vertical portions, said horizontal bottom portion being secured to the horizontal placing surface, that one end surface in each of the floor panel members which faces one another with the gap is provided a connecting plate member comprising a horizontal portion extending in a direction in which it approaches one another above the upper end of each of the vertical portions of the corresponding channel member, and an engaging portion extending vertically downwardly at the front end of each of the horizontal portions with a gap from the opposite surface of the vertical portion of the channel member, the mutually facing connecting plate members being connected separably via a cover plate means disposed astride the upper surfaces of the horizontal portions of the connecting plate members and extending along the channel member, each of the cover plate means is secured detachably to the corresponding channel member, the cover plate means is each provided with a plurality of through-holes, at least one horizontally transversely end part of each of the channel members protrudes horizontally transversely from one or the other of the upright support members, and a drainage means including a drainage hole is formed at the horizontal bottom portion in the protruding one end part of the channel member.

* * * * *